US008075373B2

(12) United States Patent
Wang

(10) Patent No.: US 8,075,373 B2
(45) Date of Patent: Dec. 13, 2011

(54) ROLL GRINDING APPARATUS

(75) Inventor: Chung-Pei Wang, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 753 days.

(21) Appl. No.: 12/184,939

(22) Filed: Aug. 1, 2008

(65) Prior Publication Data

US 2009/0209183 A1 Aug. 20, 2009

(30) Foreign Application Priority Data

Feb. 18, 2008 (CN) ..... 2008 1 0300355

(51) Int. Cl.
*B24B 5/04* (2006.01)

(52) U.S. Cl. ..... 451/242; 451/49; 451/460

(58) Field of Classification Search ..... 451/384, 451/385, 390, 398, 460, 49, 242, 246
See application file for complete search history.

(56) References Cited

U.S. PATENT DOCUMENTS

| | | | | | |
|---|---|---|---|---|---|
| 659,778 | A * | 10/1900 | Weaver | ..... | 451/384 |
| 980,133 | A * | 12/1910 | Slavin | ..... | 451/240 |
| 1,184,496 | A * | 5/1916 | Stenvall | ..... | 451/384 |
| 2,166,037 | A * | 7/1939 | Campos | ..... | 451/240 |
| 3,027,693 | A * | 4/1962 | Armitage | ..... | 451/460 |

* cited by examiner

*Primary Examiner* — Robert Rose
(74) *Attorney, Agent, or Firm* — Altis Law Group, Inc.

(57) ABSTRACT

A roll grinding apparatus includes a clamping device, a grinding wheel, a first driver, and a second driver. The clamping device includes a base, a support connected with the base and being movable relative to the base, a first clamping member and a second clamping member coupled to the first clamping member. The first clamping member and the second clamping member are rotatably mounted on the support for cooperating to clamp the workpiece. The first clamping member and the second clamping member are movable relative to the grinding wheel by movement of the support relative to the base so that the rotary axes of the first and second clamping members are adjusted to be parallel to a central axis of the grinding wheel. The first driver is connected with the first clamping member. The second driver is connected with the second clamping member.

14 Claims, 4 Drawing Sheets

ROLL GRINDING APPARATUS

CROSS REFERENCE TO RELATED APPLICATION

This application is related to commonly-assigned copending application Ser. No. 12/178,819, entitled "GRINDING APPARATUS HAVING PRESSING PORTION AND GRINDING METHOD USING SAME". Disclosures of the above-identified application are incorporated herein by reference.

BACKGROUND

1. Technical Field

The present invention relates to roll grinding apparatuses, particularly to an adjustable roll grinding apparatus.

2. Description of related art

A roll grinding apparatus is generally utilized to round and/or polish a workpiece. Referring to FIG. 4, a typical roll grinding apparatus 10 includes a pair of clamping members 100, 110, and a pair of drivers 120, 122 respectively connected with the clamping members 110, 100, and a grinding wheel 130. In a roll grinding process, the clamping members 100, 110 cooperate to clamp a number of stacked workpieces 12 being treated. The drivers 120, 122 drive the clamping members 100, 110 to rotate around a rotary axis thereof. During rotating, the workpieces 12 clamped by the clamping members 100, 110 are ground and rounded by the grinding wheel 130.

In general, to ensure the roll grinding precision of the workpieces 12, it is necessary for a central axis of the workpieces 12 to be coaxial with the rotary axis of the driver 120, 122 in the X direction shown in FIG. 4, and simultaneously to be parallel to a central axis of the grinding wheel 130 in the Y direction shown in FIG. 4. However, the workpieces 12 are usually mounted on the typical roll grinding apparatus 10 manually. Thus, the central axis of the workpieces 12 and the rotary axis of the driver 120, 122 can undergo a positional excursion, thereby affecting the roll grinding precision of the workpieces 12. Moreover, it is difficult to adjust the position of the workpieces 12 mounted on the typical roll grinding apparatus 10 to avoid the positional excursion between the central axis of the workpieces 12 and the rotary axis of the driver 120, 122. The typical roll grinding apparatus 10 is time consuming and lacks of efficiency.

What is needed, therefore, is a roll grinding apparatus capable of adjusting the workpieces mounted thereon easily, thereby ensuring the roll grinding precision of the workpieces.

SUMMARY

One present embodiment provides a roll grinding apparatus for roll grinding a workpiece. The roll grinding apparatus includes a clamping device, a grinding wheel, a first driver, and a second driver. The clamping device includes a base, a support connected with the base and being movable relative to the base, a first clamping member and a second clamping member coupled to the first clamping member. The first clamping member and the second clamping member are rotatably mounted on the support for cooperating to clamp the workpiece. A rotary axis of the first clamping member and that of the second clamping member are substantially coaxial. The grinding wheel is configured for grinding the workpiece. The first clamping member and the second clamping member are movable relative to the grinding wheel by movement of the support relative to the base so that the rotary axes of the first and second clamping members are adjusted to be parallel to a central axis of the grinding wheel. The first driver is connected with the first clamping member and configured for driving the first clamping member rotate around a rotary axis of the first driver. The second driver is connected with the second clamping member and configured for driving the second clamping member rotate around a rotary axis of the second driver.

BRIEF DESCRIPTION OF THE DRAWINGS

Many aspects of the present embodiment can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE EMBODIMENTS

Figure 1:
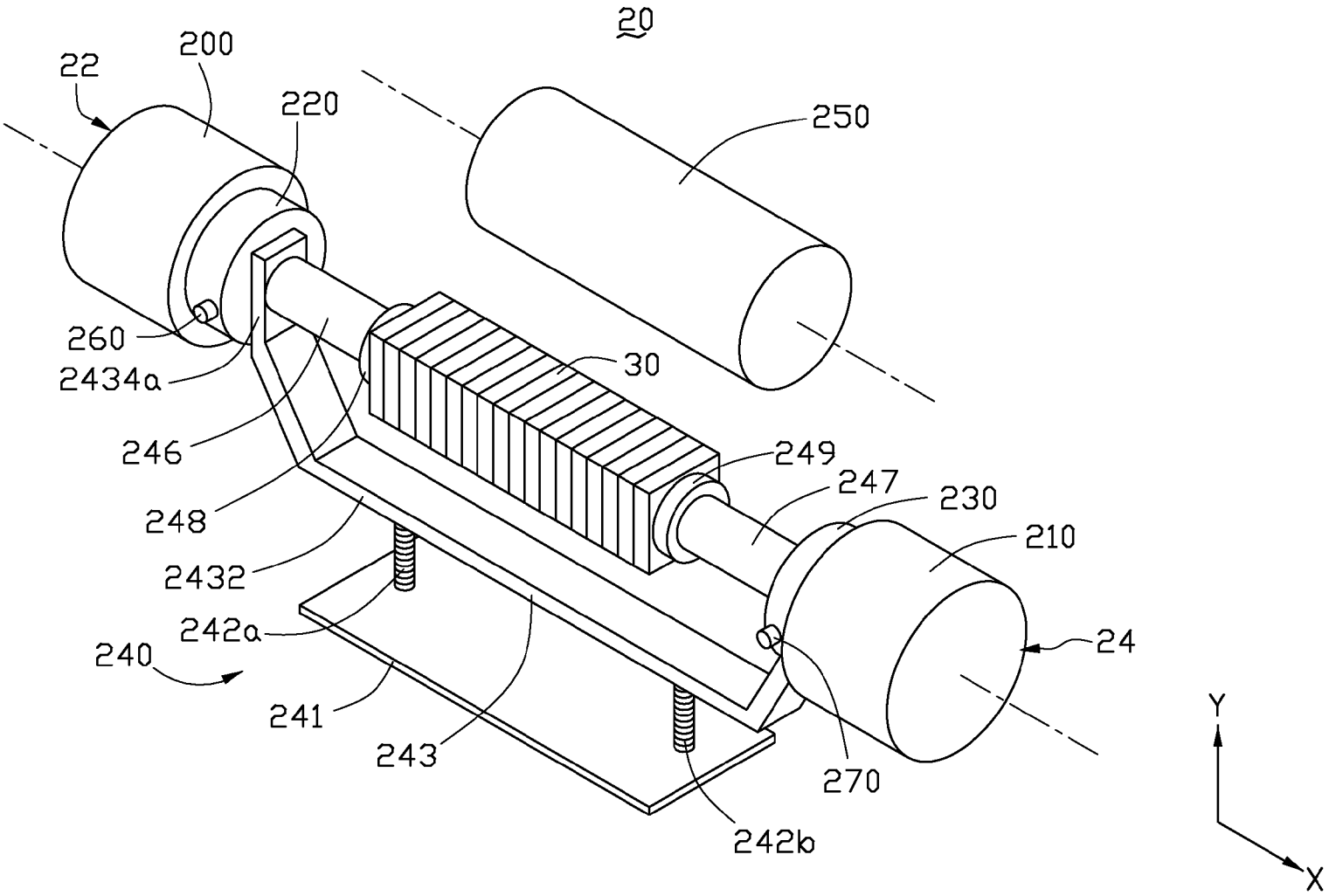
FIG. 1 is a schematic view of a roll grinding apparatus according to a present embodiment.

Embodiment will now be described in detail below and with reference to the drawing.

Figure 2:
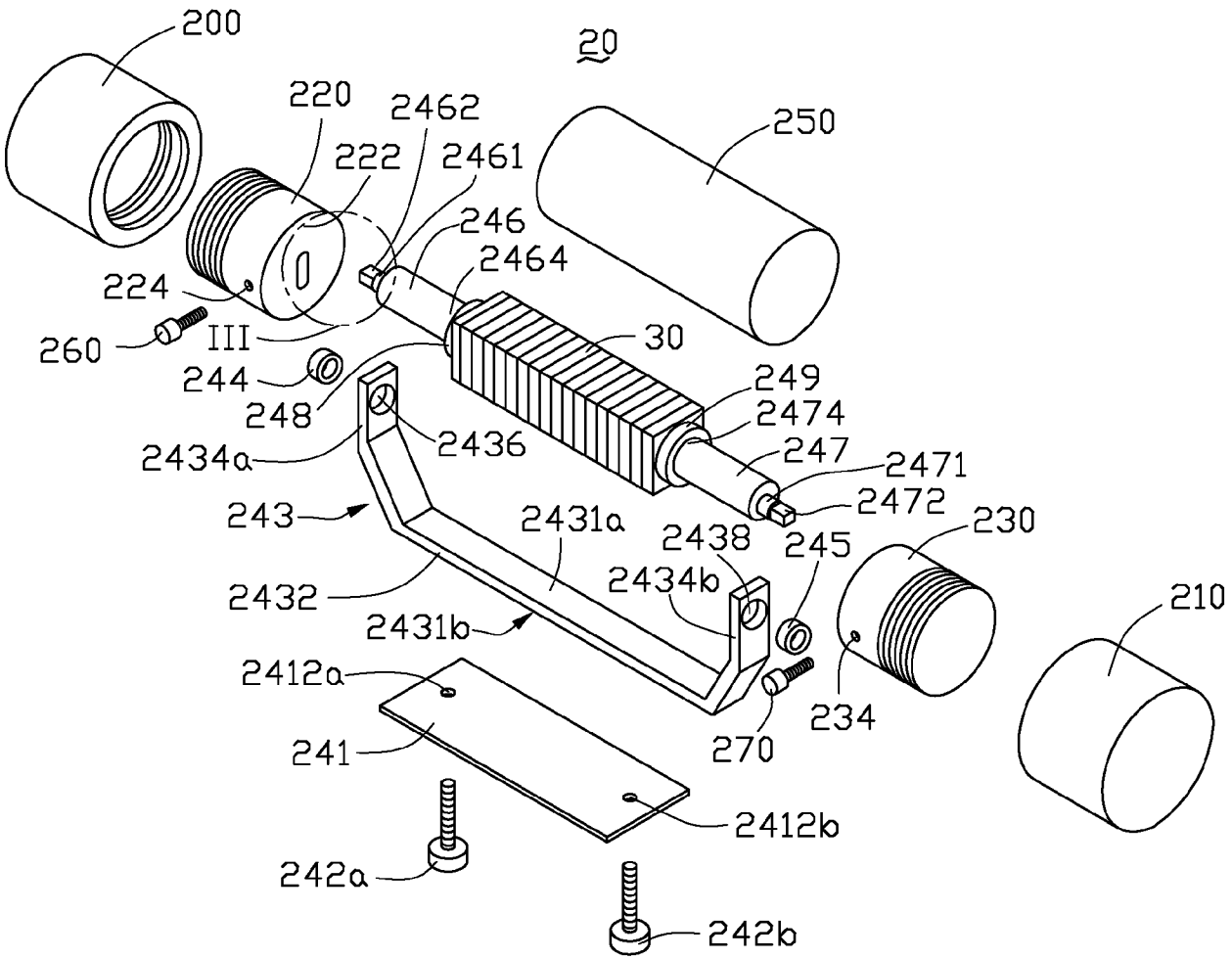
FIG. 2 is an exploded, schematic view of a roll grinding apparatus shown in FIG. 1.

Referring to FIG. 1 and FIG. 2, an exemplary roll grinding apparatus 20 for roll grinding a number of workpieces 30 is provided according to a present embodiment. In the present embodiment, the workpieces 30 are rectangular and stacked one by one to be ground and rounded. It is noted that the roll grinding apparatus 20 can be used to grind only one workpiece 30. The roll grinding apparatus 20 includes a clamping device 240, a grinding wheel 250, a first diver 22, and a second driver 24.

The clamping device 240 is configured for clamping the workpieces 30. The clamping device 240 includes a base 241, a support 243, a first clamping member 246, and a second clamping member 247 coupled to the first clamping member 246. The base 241 is connected with the support 243. The support 243 is movable relative to the base 241. The first clamping member 246 and the second clamping member 247 are rotatably mounted on the support 243 for cooperating to clamp the workpieces 30. The first clamping member 246 and the second clamping member 247 are movable due to the movement of the support 243.

In detail, the base 241 is connected with the support 243 via a first screw bolt 242*a* and a second screw bolt 242*b*. The base 241 defines a first screw hole 2412*a* and a second screw hole 2412*b* therein. The first screw bolt 242*a* is threadedly received in the first screw hole 2412*a*, and the second screw bolt 242*b* is threadedly received in the second screw hole 2412*b*. A length of the first screw bolt 242*a* is larger than a depth of the first screw hole 2412*a*, and a length of the second screw bolt 242*b* is larger than a depth of the second screw hole 2412*b*.

The support 243 includes a base plate 2432, a first side plate 2434*a* and a second side plate 2434*b* connected to the base plate 2432. The base plate 2432 has a top surface 2431*a* and a bottom surface 2431*b*. The first side plate 2434*a* and the second side plate 2434*b* are located on two opposite ends of the base plate 2432, respectively, and extend away from the top surface 2431*a* of the base plate 2432. One end of each of the first screw bolt 242*a* and the second screw bolt 242*b* is threadedly connected with the bottom surface 2431*b* of the base plate 2432. The support 243 is movable relative to the base 241 by adjusting the first screw bolt 242*a* and the second screw bolt 242*b*. The first side plate 2434*a* defines a first mounting hole 2436 for rotatably mounting the first clamping member 246 therein. The second side plate 2434*b* defines a second mounting hole 2438 for rotatably mounting the first clamping member 247 therein. In the present embodiment, a first bearing 244 is installed in the first mounting hole 2436 for rotatably mounting the first clamping member 246 therein and a second bearing 245 is installed in the second mounting hole 2438 for rotatably mounting the first clamping member 247 therein. A rotary axis of the first clamping member 246 and that of the second clamping member 247 are substantially coaxial in the X direction shown in FIG. 1. Thus, a rotary axis of the workpieces 30 clamped by the first clamping member 246 and the second clamping member 247 corresponds to the rotary axis of the first clamping member 246 and that of the second clamping member 247. The rotary axis of the workpieces 30 clamped by the first clamping member 246 and the second clamping member 247, the rotary axis of the first clamping member 246 and the rotary axis of the second clamping member 247 are substantially coaxial.

The first clamping member 246 cooperates with the second clamping member 247 for clamping the workpieces 30 therebetween. The first clamping member 246 includes a first end 2461 and an opposite second end 2464. The first end 2461 of the first clamping member 246 is configured for being received into the first bearing 244 to rotatably mount the first clamping member 246 to the first side plate 2434*a* via the first bearing 244. The first end 2461 of the first clamping member 246 has a first protrusion 2462. The first protrusion 2462 is configured for coupling to a recess of the first driver 22. The second end 2464 of the first clamping member 246 is configured for cooperating with the second clamping member 247 to clamp the workpieces 30.

Similarly, the second clamping member 247 includes a first end 2471 and an opposite second end 2474. The first end 2471 of the second clamping member 247 is configured for being received into the second bearing 245 to rotatably mount the second clamping member 247 to the second side plate 2434*b* via the second bearing 245. The first end 2471 of the second clamping member 247 has a second protrusion 2472. The second protrusion 2472 is configured for coupling to a recess of the second driver 24. The second end 2474 of the second clamping member 247 is configured for cooperating with the second end 2464 of the first clamping member 246 to clamp the workpieces 30.

Advantageously, a first contacting member 248 is connected with the second end 2464 of the first clamping member 246, and a second contacting member 249 is connected with the second end 2474 of the second clamping member 247. The first contacting member 248 and the second contacting member 249 are configured for abutting against the workpieces 30 so that the first clamping member 246 and the second clamping member 247 cooperate to clamp the workpieces 30. The first contacting member 248 and the second contacting member 249 each is comprised of an elastic material selected from a group consisting of an epoxy resin and a rubber. Thus, the workpieces 30 clamped between the first and second contacting members 248, 249 can be prevented from being damaged.

The grinding wheel 250 is configured for grinding the workpieces 30. The grinding wheel 250 is located towards the workpieces 30 clamped by the first clamping member 246 and the second clamping member 247. A central axis of the grinding wheel 250 and the rotary axis of the first clamping member 246 (i.e., the rotary axis of the second clamping member 247) are coplanar. The grinding wheel 250 is movable in a direction of the central axis thereof.

The first driver 22 is configured for driving the first clamping member 246 to rotate. The first driver 22 includes a first drive shaft 200 connected with the first clamping member 246. The first drive shaft 200 is driven by the first driver 22 to rotate around a rotary axis of the first drive shaft 200, thereby driving the workpieces 30 clamped by the clamping device 240 to rotate around the rotary axis of the first drive shaft 200. The rotary axis of the first drive shaft 200 and the rotary axis of the first clamping member 246 are substantially coaxial.

Similarly, the second driver 24 is configured for driving the second clamping member 247 to rotate. The second driver 24 includes a second drive shaft 210 connected with the second clamping member 247. The second drive shaft 210 is driven by the second driver 24 to rotate around a rotary axis of the second drive shaft 210, thereby driving the workpieces 30 clamped by the clamping device 240 to rotate around the rotary axis of the second drive shaft 210. The rotary axis of the second drive shaft 210 and the rotary axis of the second clamping member 247 are substantially coaxial. Thus, the rotary axis of the first driver 22, the rotary axis of the second driver 24, the rotary axis of the first clamping member 246 and the rotary axis of the second clamping member 247 are all substantially coaxial in the X direction shown in FIG. 1.

Figure 3:
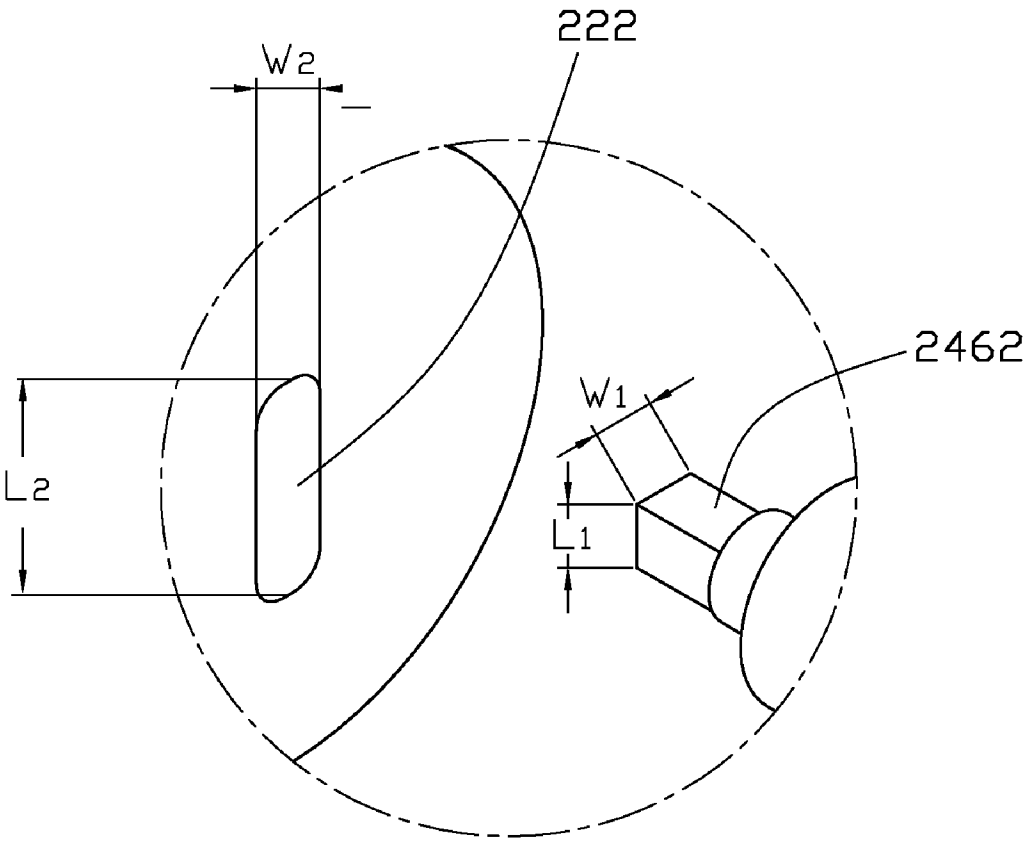
FIG. 3 is an enlarged, schematic view of the III part shown in FIG. 2.
Figure 4:
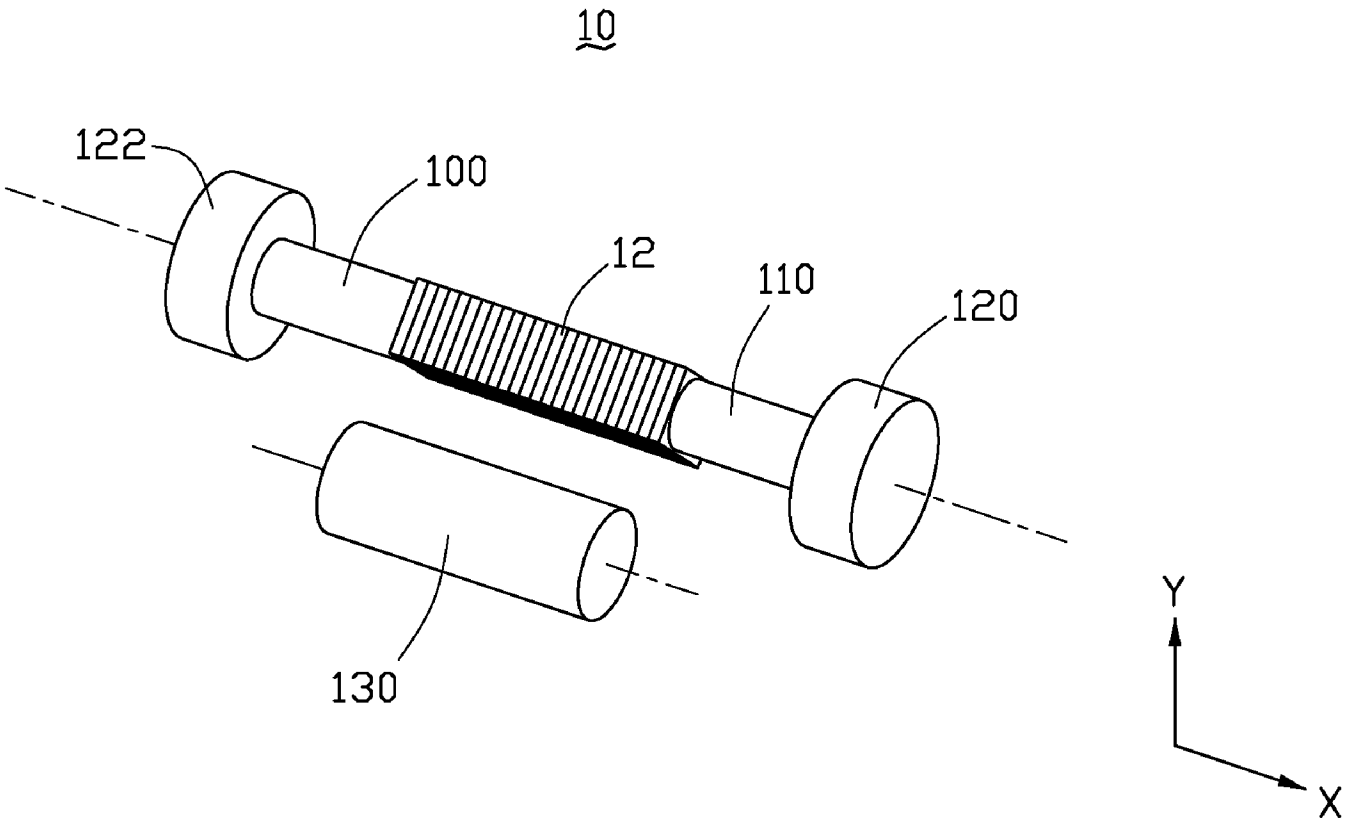
FIG. 4 (RELATED ART)
FIG. 4 is a schematic view of a typical roll grinding apparatus.

The first clamping member 246 can be movable relative to the grinding wheel 250 (e.g., towards to the grinding wheel 250 or away from the grinding wheel 250) due to the movement of the support 243 so that the rotary axis of the first clamping member 246 is parallel to the central axis of the grinding wheel 250. In the present embodiment, the first driver 22 includes a first connecting member 220. The first clamping member 246 is connected to the first drive shaft 200 via the first connecting member 220. One end of the first connecting member 220 is threadedly connected with the first drive shaft 200, the other end of the first connecting member 220 defines a first recess 222 corresponding to the first protrusion 2462. The first protrusion 2462 is capable of moving in the first recess 222 so that the first clamping member 246 can be movable relative to the grinding wheel 250. In the present embodiment, referring to FIG. 3, a cross-section configuration of the first recess 222 is in an elongated shape. The first recess 222 is elongated in the direction towards the central axis of the grinding wheel 250. As such, the first clamping member 246 is adjustably movable in the first recess 222 toward or away from the central axis of the grinding wheel 250. A length L1 of the first protrusion 2462 is less than a length L2 of the first recess 222. A width W1 of the first protrusion 2462 is equal to a width W2 of the first recess 222. In addition, the first connecting member 220 defines a third screw hole 224. A third screw bolt 260 is received in the third screw hole 224 for fixing the first connecting member 220 and the first clamping member 246 when the first protrusion 2462 moves to a predetermined position.

The second clamping member 247 also can be movable relative to the grinding wheel 250 (e.g., towards to the grinding wheel 250 or away from the grinding wheel 250) due to the movement of the support 243 so that the rotary axis of the second clamping member 247 is parallel to the central axis of the grinding wheel 250. In the present embodiment, the second driver 24 includes a second connecting member 230. The second connecting member 230 has a similar structure to the first connecting member 220. One end of the second connecting member 230 is threadedly connected with the second drive shaft 210, the other end of the second connecting member 230 defines a second recess (not shown) corresponding to the second protrusion 2472. The second protrusion 2472 is capable of moving in the second recess so that the second clamping member 247 can be movable relative to the grinding wheel 250. In the present embodiment, a cross-section configuration of the second recess is in an elongated shape in the direction towards the central axis of the grinding wheel 250. A length of the second protrusion 2472 is less than that of the second recess. A width of the second protrusion 2472 is equal to that of the second recess. In addition, the second connecting member 230 defines a fourth screw hole 234. A fourth screw bolt 270 is received in the fourth screw hole 234 for fixing the first connecting member 230 and the first clamping member 247 when the first protrusion 2472 moves to a predetermined position.

Advantageously, the moving direction of the first protrusion 2462 is perpendicular to the central axis of the grinding wheel 250 and the moving direction of the second protrusion 2472 is perpendicular to the central axis of the grinding wheel 250.

When the central axis of the grinding wheel 250 and the rotary axis of the workpieces 30 (i.e., the rotary axis of the first clamping member 246 or the rotary axis of the second clamping member 247) undergo a positional excursion, the rotary axis of the workpieces 30 can be adjusted. For example, the central axis of the grinding wheel 250 is not parallel to the rotary axis of the workpieces 30. The first screw bolt 242*a* and the second screw bolt 242*b* can be screwed into or out of the support 243 respectively to adjust a distance between the base 241 and the support 243, thereby adjusting a position of the rotary axis of the workpieces 30 clamped by the clamping device 240 in the Y direction shown in FIG. 1. As a result, the central axis of the workpieces 30 can be adjusted to be parallel to the central axis of the grinding wheel 250.

When a centre of the central axis of the grinding wheel 250 and a centre of the rotary axis of the workpieces 30 clamped by the clamping device 240 undergo a positional excursion, the centre of the central axis of the workpieces 30 clamped by the clamping device 240 can be adjusted. The first connecting member 220 and the second connecting member 230 can be screwed into or out of the first drive shaft 200 and the second drive shaft 210 respectively to adjust a distance between the first clamping member 246 and the second clamping member 247, thereby adjusting a position of the centre of the rotaryl axis of the workpieces 30 clamped by the clamping device 240 in the X direction shown in FIG. 1.

While certain embodiments have been described and exemplified above, various other embodiments will be apparent to those skilled in the art from the foregoing disclosure. The present invention is not limited to the particular embodiments described and exemplified but is capable of considerable variation and modification without departure from the scope of the appended claims.

What is claimed is:

1. A roll grinding apparatus for roll grinding a workpiece, comprising:

a clamping device comprising a base defining a first screw hole and a second screw hole therein, a first screw bolt threadedly received in the first screw hole, a second screw bolt threadedly received in the second screw hole, a support comprising a base plate, a first side plate and a second side plate located on opposite ends of the base plate respectively and extending away from a top surface of the base plate, the base plate having a top surface and a bottom surface, the first screw bolt and the second screw bolt being threadedly connected with the bottom surface of the base plate, a first clamping member and a second clamping member coupled to the first clamping member, the first clamping member being rotatably mounted on the first side plate, and the second clamping member being rotatably mounted on the second side plate, the first clamping member and the second clamping member cooperating to clamp the workpiece, a rotary axis of the first clamping member and that of the second clamping member being substantially coaxial;

a grinding wheel for grinding the workpiece, the first clamping member and the second clamping member being movable relative to the grinding wheel by movement of the support relative to the base so that the rotary axes of the first and second clamping members are adjusted to be parallel to a central axis of the grinding wheel;

a first driver connected with the first clamping member, the first driver being configured for driving the first clamping member rotate around a rotary axis of the first driver; and a second driver connected with the second clamping member, the second driver being configured for driving the second clamping member rotate around a rotary axis of the second driver.

2. The roll grinding apparatus as claimed in claim 1, wherein the first side plate defines a first mounting hole therein for mounting the first clamping member, and the second side plate defines a second mounting hole therein for mounting the second clamping member.

3. The roll grinding apparatus as claimed in claim 2, further comprising a first bearing installed in the first mounting hole for bearing the first clamping member, and a second bearing installed in the second mounting hole for bearing the second clamping member.

4. The roll grinding apparatus as claimed in claim 1, wherein a central axis of the grinding wheel and the rotary axis of the first driver are coplanar, and the first clamping member is movable in a direction perpendicular to the central axis of the grinding wheel.

5. The roll grinding apparatus as claimed in claim 4, wherein the grinding wheel is movable in a direction of the central axis thereof.

6. The roll grinding apparatus as claimed in claim 1, wherein the first driver comprises a first drive shaft connected with the first clamping member, the second driver comprises a second drive shaft connected with the second clamping member.

7. The roll grinding apparatus as claimed in claim 6, wherein the first driver comprises a first connecting member, the second driver comprises a second connecting member, the first drive shaft is connected with the first clamping member via the first connecting member, and the second drive shaft is connected with the second clamping member.

8. The roll grinding apparatus as claimed in claim 7, wherein the first clamping member has a first protrusion, the second clamping member has a second protrusion, the first connecting member defines a first recess corresponding to the first protrusion and the second connecting member defines a second recess corresponding to the second protrusion, the first protrusion is capable of moving in the first recess and the second protrusion is capable of moving in the second recess.

9. The roll grinding apparatus as claimed in claim 8, wherein a cross-section of the first recess is in an elongated shape elongated in the direction towards the central axis of the grinding wheel, a cross-section of the second recess is in an elongated shape elongated in the direction towards a central axis of the grinding wheel, a length of the first protrusion is less than that of the first recess, and a length of the second protrusion is less than that of the second recess.

10. The roll grinding apparatus as claimed in claim 9, wherein a width of the first protrusion is equal to that of the first recess, and a width of the second protrusion is equal to that of the second recess.

11. The roll grinding apparatus as claimed in claim 7, wherein the first connecting member is threadedly connected with the first drive shaft, and the second connecting member is threadedly connected with the second drive shaft.

12. The roll grinding apparatus as claimed in claim 1, further comprising a first contacting member connected with the first clamping member and a second contacting member connected with the second clamping member, and the first contacting member and the second contacting member cooperate for clamping the workpiece therebetween.

13. The roll grinding apparatus as claimed in claim 12, wherein the first contacting member and the second contacting member are comprised of an elastic material.

14. The roll grinding apparatus as claimed in claim 13, wherein the elastic material is selected from a group consisting of an epoxy resin and a rubber.

* * * * *